US006350129B1

(12) United States Patent
Gorlick

(10) Patent No.: US 6,350,129 B1
(45) Date of Patent: Feb. 26, 2002

(54) WEARABLE ELECTRONICS CONDUCTIVE GARMENT STRAP AND SYSTEM

(75) Inventor: Michael M. Gorlick, El Segundo, CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 09/689,246

(22) Filed: Oct. 11, 2000

(51) Int. Cl.[7] ..... H01R 33/00
(52) U.S. Cl. ..... 439/37; 439/8
(58) Field of Search ..... 439/37, 500, 8

(56) References Cited

U.S. PATENT DOCUMENTS 1,691,472 A * 11/1928 Graham et al. ..... 439/37
2,342,744 A * 2/1944 McCready ..... 439/37
5,531,601 A * 7/1996 Amoroso ..... 439/37
5,934,225 A * 8/1999 Williams ..... 439/37

* cited by examiner

*Primary Examiner*—Tho D. Ta
(74) *Attorney, Agent, or Firm*—Derrick Michael Reid

(57) ABSTRACT

An electrical conductive strap having two conductive wires is used to communicate power and signals to batteries and electronic devices attached to the strap using conductive snaps. The strap is embedded in clothing for attaching personal wearable electronic devices to the clothing are comfortable to wear as common articles of clothing such as blouses, pants, and belts. The strap is made of woven materials such as conductive webbings, which is incorporated durable electrical conductors directly into the conductive for closely integrating digital electronics with conventional clothing.

13 Claims, 4 Drawing Sheets

BALL SNAP CONTACT SIDE VIEW

SOCKET SNAP CONTACT SIDE VIEW

BALL SNAP CONTACT TOP VIEW

BALL SNAP CONTACT SIDE VIEW

SOCKET SNAP CONTACT TOP VIEW

SOCKET SNAP CONTACT SIDE VIEW

CONDUCTIVE GARMENT STRAP

GARMENT BATTERY FRONT VIEW

BATTERY SIDE VIEW

GARMENT ELECTRONICS

WEARABLE ELECTRONICS CONDUCTIVE GARMENT STRAP AND SYSTEM

FIELD OF THE INVENTION

The invention relates to the fields of wearable electronic devices and garments. More particularly, the invention relates to conductive straps for attaching wearable electronics having power and communicating signals routed through straps embedded within garments.

BACKGROUND OF THE INVENTION

People are increasingly using portable electronic devices for applications such as communications, medical monitoring, costume lights and computing devices. These devices require battery power and are being reduced in size for convenient personal use. Humans wear clothing to which they attach these devices, such as clipping a cellular phone to a belt. Electronic devices are attached to clothing in various ways. For example, in the motion picture industry, characters, both real and imaginary, are often equipped with entertaining lights, such as an extraterrestrial being with red light eyes. The realistic animation of imaginary characters may require the distribution of tracking lights about a moving human being as an aid in tracking, recording, and digitizing motions of a human being that are then applied to the animation of the imaginary characters. These electronic devices are typically lights represented as required with power and communication means.

These and other like devices must be comfortable to wear while enabling electronic communications and power distribution among the various wearable electronic components. However, such wearable electronics are at present uncomfortable to wear for more than a brief period and do not have wiring suitable for permanent comfortable use while enabling the use of a variety of differing devices. Often, in such circumstances, wires break from constant human movement when worn, and are subject to unreliable electrical connectors when interconnecting conventional electronics. These and other disadvantages are solved or reduced using the invention.

SUMMARY OF THE INVENTION

An object of the invention is to provide a conductive strap for routing signals between attached electronic devices.

Another object of the invention is to provide a conductive strap embedded in clothing for routing signals between attached electronic devices.

Yet another object of the invention is to provide a conductive strap embedded in clothing for routing signals between attached wearable electronic devices using reliable contacts embedded within the strap.

Still another object of the invention is to provide a conductive strap embedded in clothing for routing power and communications signals between attached wearable electronic devices using reliable contacts embedded within the strap.

The invention is directed to an electrical conductive strap having at least two conductive wires that are used to communicate power and signals between batteries and electronic devices attached to the strap using conductive snaps. The conductive snaps are preferably made from common garment snaps and provide reliable electronic connection between the attached wearable electronic devices. The strap is embedded in clothing for attaching personal electronic devices to the clothing. The strap and attached devices can be comfortably worn as common articles of clothing. The strap can be embedded and sewn into various different articles of clothing such as blouses, pants, and belts. The strap is made of woven materials such as a conductive webbing, which incorporates durable electrical conductors directly into the conductive strap for the purpose of closely integrating attached electronics with conventional clothing. These and other advantages will become more apparent from the following detailed description of the preferred embodiment.

DETAILED DESCRIPTION OF THE PREFERRED EMBODIMENT

An embodiment of the invention is described with reference to the figures using reference designations as shown in the figures.

Figure 1A:
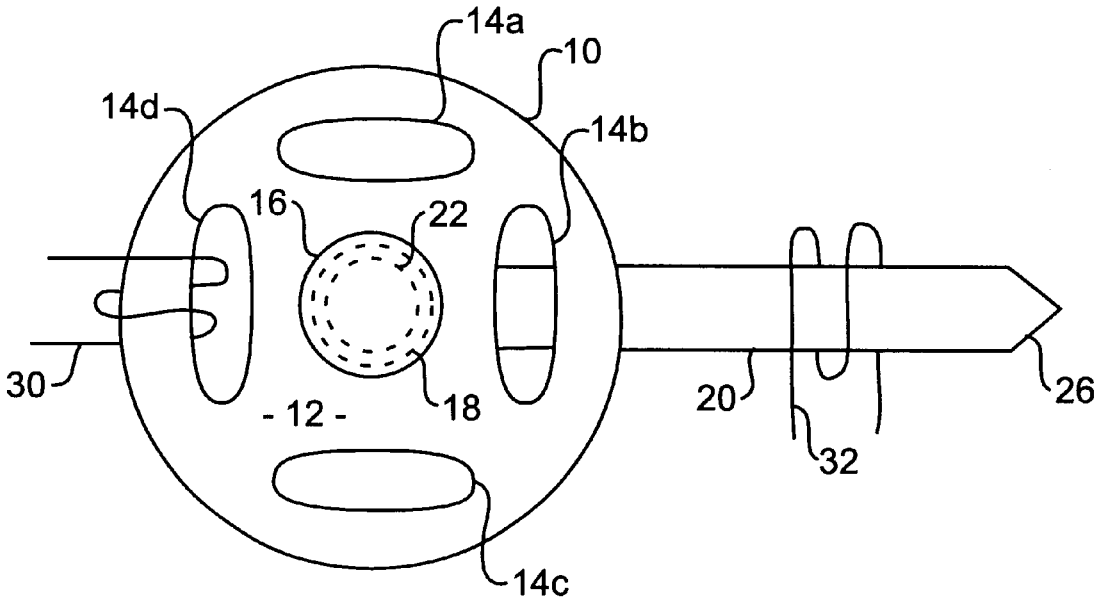
FIG. 1A is a top view of a ball snap contact.
Figure 1B:
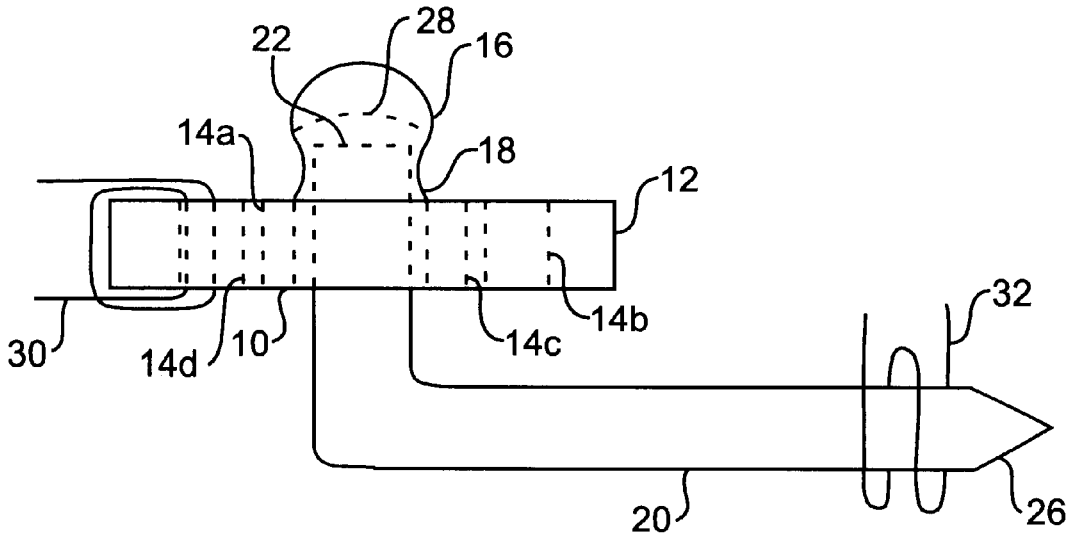
FIG. 1B is a side view of the ball snap contact.
Figure 2A:
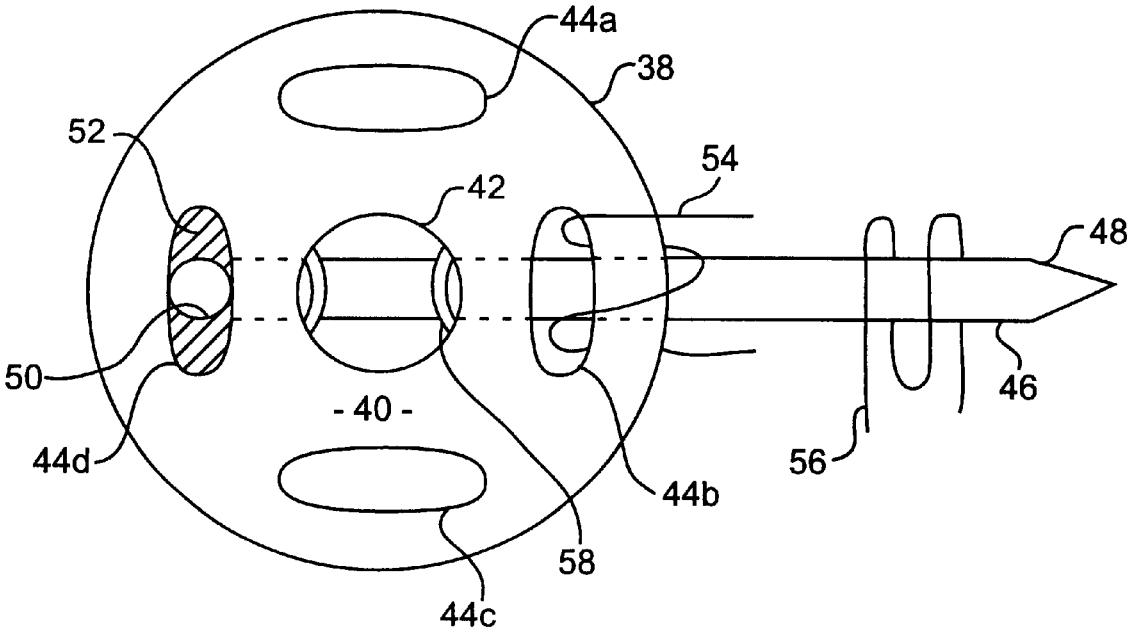
FIG. 2A is a top view of a socket snap contact.
Figure 2B:
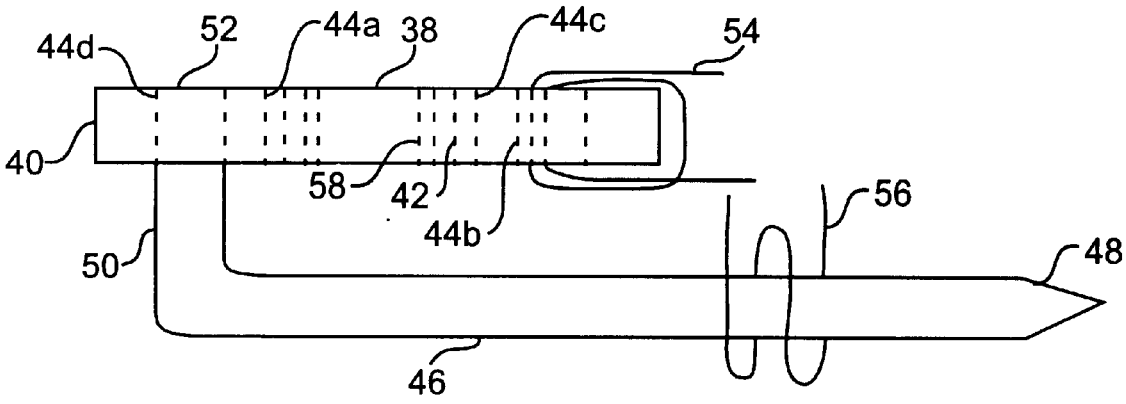
FIG. 2B is a side view of the socket snap contact.

Referring to FIGS. 1A, 1B, 2A and 2B, a common garment ball snap 10 is used as an electrical male contact. The ball snap 10 has a flat disk 12 with sewing holes 14*abcd* and an upwardly extending hollow ball 16 having a slight concave curve edge 18. A bent pin 20 having a pin end 22 and a pin point 26. The pin end 22 is inserted into the hollow ball and soldered permanently into hollow ball 16 using solder 28. Threads 30 and 32 are used to secure the ball snap 10 using the sewing holes 14*abcd*. FIGS. 2A and 2B show a common garment socket snap 38 that is used as an electrical female contact. The socket snap 38 also has a flat disk 40 but with a center socket aperture 42 and with sewing holes 44*abcd*. Another bent pin 46 has a pin point 48 and pin end 50. The pin end 50 is inserted into one of the sewing holes, such as hole 44*d* as shown, and the pin end 50 is secured in the hole 44*d* using solder 52. Threads 54 and 56 are used to secure the socket snap 10. The socket snap 38 also including flanges 58 extending into the socket aperture 42 for mating with a male ball snap such as ball snap 10. The flanges 58 are spring loaded for a snug snap fit into curved edges 18 for securing the ball snap 10 within the socket aperture 42 of the socket snap 38. The ball snap 10 and socket snap 38 form an electrical connector.

Figure 3:
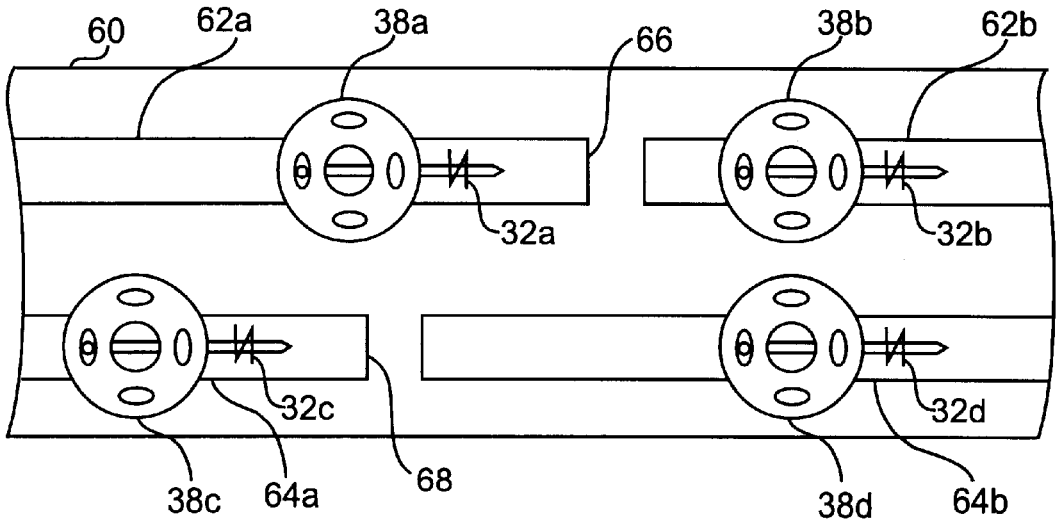
FIG. 3 depicts a conductive garment strap.

Referring to FIGS. 1A, 1B, 2A, 2B, 3, and more particularly to FIG. 3, a plurality of socket snaps 38*abcd* are shown sewed and embedded within a garment strap 60 that may be made of a insulating garment material. Two conductive wires 62*abcd* are shown embedded in the strap 60. Each of the conductive wires 62*abcd* are shown having a respective socket snap 38*abcd* sewed into the wires 62*abcd* respectively using sewing threads 32*abcd*. The threads may be conductive threads for reliable electrical contacts. Conductive wires 62*a* and 62*b*, and 62*c* and 62*d*, are shown separated by respective gaps 66 and 68. The gaps 66 and 68 can be formed by simply cutting away a small portion of the two conducting wires 62*ab* and 62*cd*. In so doing, electrical isolation between various segments of the wires 62*abcd* can be created for configuring desired electrical routing. The wired 62*abcd* are preferably stranded stainless steel wires into which pin ends 48 and 26 may be inserted as sewed so as to secure the snaps 38*abcd* to the wires 62*abcd* respectively using threads 38*abcd* and so as to make respective secured electrical contacts between the snaps 38*abcd* and the wires 62*abcd*. The snaps 38*abcd* may be either ball snaps 10 or socket snaps 38 for flexible system configuration and connecting. The snaps 38*abcd* are preferably socket snaps 38. Ball snaps 10 may also be secured to the wires 62*abcd* with the disk 12 secured to the strap 60 using threads 30 with the pin 20 secured to the wire 62*abcd* using threads 32. The snaps 38*abcd* being either ball snaps 10 or socket snaps 38 are also secured to the strap 60 using threads such as threads 32 and 54. As such, the strap 60 can be configured as a flexible cable harness having routing wires 62*abcd* and contact snaps 32*abcd*. The pins 20 and 46 have a short length of stiff and sharpened stainless steel. The pins 20 and 46 are bent into an L shape with the short leg of the L inserted into the interior of the ball of the ball snap or a sewing hole for the socket snap where the pins are secured with solder. These pins 20 and 36 are stingers that penetrates the webbing wires and is preferably inserted parallel to, and inside of, the wires 62*abcd* that may be a conductor bundle or stranded conductive cable. The wires 62*abcd* should be reliable inexpensive conductors capable of maintaining electrical integrity over long use. Human perspiration is both highly conductive and corrosive and care must be taken to place devices away from underarm locations.

The strap 60 and the conductive wires 62*abcd* may be webbing woven in various widths and used for belts, carrying straps, and harnesses. Webbings can have varied yarns, weave, thickness, and width, and can be engineered to precise specifications including strength, durability, and flexibility. A strap is preferably made of Nomex with two pairs of stainless steel conductors woven directly into the webbing. The webbing is flexible and the stiffness is due more to the thickness of the weave and the yarn diameters than the conductors. Each conductor wire 62*abcd* is a bundle of twenty strands of stainless steel wire. The webbing lies flat with the conductors neatly sandwiched between the two major planes of the webbing. The four conductors are insulated by the Nomex yarn. Each conductor pair may be bonded together at the ends of each webbing strap segment to produce two single conductors, one on either side of the webbing, if desired.

Figure 4A:
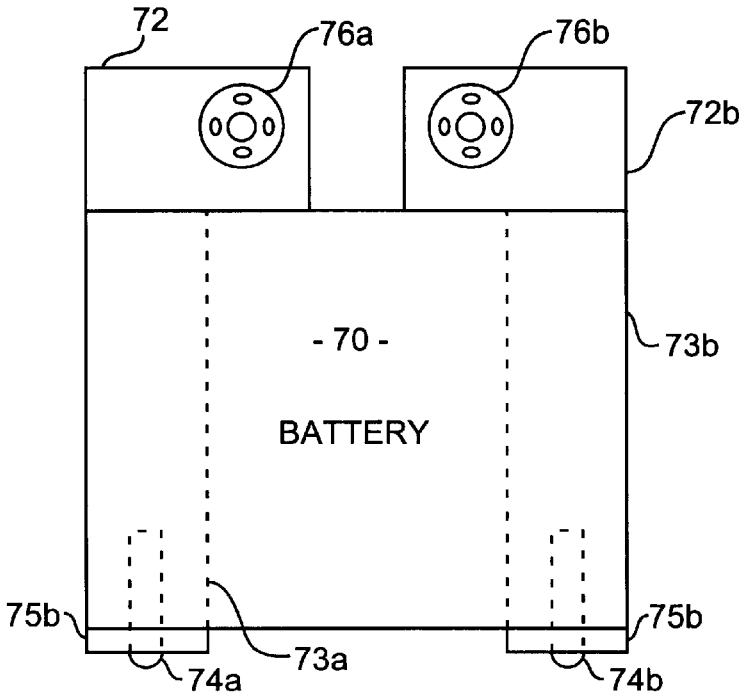
FIG. 4A is a front view of a garment battery.
Figure 4B:
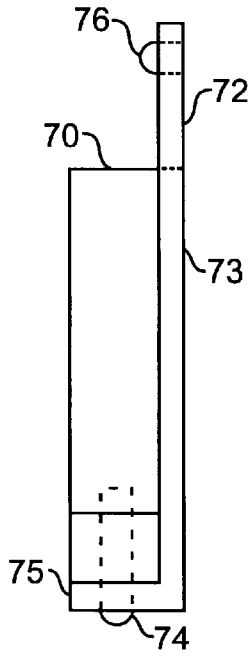
FIG. 4B is a side view of the garment battery.
Figure 5:
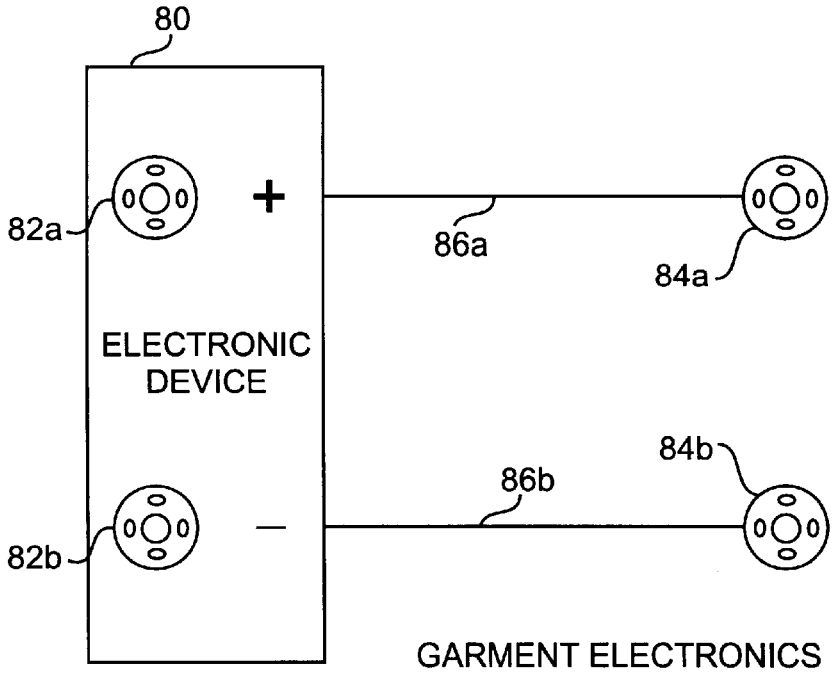
FIG. 5 depicts garment electronics.

Referring to all of the Figures, and more particularly to FIGS. 4A, 4B and 5, a battery 70 is affixed to a holder having two conductive brackets 72*a* and 72*b*. Each bracket 72*a* and 72*b* have respective elongated portions 73*a* and 73*b*, screws 74*a* and 74*b*, and bent flanges 75 for securing the battery 70 to the brackets 72 and for making electrical connection with the snaps 76, that are preferably ball snaps 10. The screws 74*a* and 74*b* and flanges 75*a* and 76*b* provide electrical contact with the battery 70 having contact screw 74. Each of the brackets 72*a* and 72*b* respectively have ball snaps 76*a* and 76*b* providing electrical conductivity through the snaps 76*ab*, through the conductive brackets 76*ab* to the battery 70. The battery holder may be designed for an inexpensive small 7.2V 1.3A-H Lithium rechargeable battery. Unlike many other batteries, the negative and positive electrodes are deeply recessed in one end of the battery to prevent inadvertent short circuits. The entire battery holder is preferably designed to fit into a small cloth pocket and can be connected to the strap using extension wires. The plastic plate 72 forming the brackets 72*a* and 72*b* of the battery holder can be drilled and grooved permitting the bracket to be firmly sewn into clothing, if desired. A pattern of holes at the end of each bracket accommodates either a ball or socket sew-on snap 72. The distance between the ball snaps 72 is equal to the distance between the socket snaps, for example socket snaps 38*b* and 38*d* for snapping the battery 70 respectively onto the conductive wires 62*b* and 62*d* of the strap 60. Like the battery 70, any arbitrary electronic device 80 can be connected by a male/female contact snapping onto the wires 62*abcd*. The electric device 80, like the battery 70, preferably has male ball snaps 82*a* and 82*b* for mating connection to the wires. Using the ball snaps 82*a* and 82*b*, the device 80 is snapped directed onto the strap 60. Sometime, it is desirable to place an electronic device, such as battery 70 or device 80 on another garment location, such as in a pant pocket or backpack. Remote ball snaps 84*a* and 84*b* using extension wires 86*a* and 86*b* are used for electrically connecting the device 80 remote to the strap but in electrical contact.

As may be apparent, the conductive strap 60, as well as attached electronics and snap connectors can be attached or coupled to the strap 60. The conductive wiring strap 60 can be sewn into a common article of clothing, for example, as suspenders that then function as an effective power bus and/or data communication network for wearable electronic devices. The wires 62*abcd* can function as a power bus or as a data communication network. The strap 60 offers flexible system configuration for power and signal distribution about that strap 60 embedded in clothing. Electrical materials like the conductive webbing or stranded wires must endure repeated machine washings without loss of conductivity or mechanical strength. With the electronic devices removed from the strap 60, the strap can be repeatedly machine washed without corrosion, fatigue deterioration, or loss of electrical contact. The strap should permit the easy and repeated connection and disconnection of devices while resisting extreme temperatures and humidity. Stainless steel wires and webbing is well suited for repeated use. The strap is compatible with common clothing manufacturing techniques and provides reliable electrical and mechanical connections. The conductive strap can be manufactured in a variety of widths, weights, colors, and patterns. The conductive straps 60 can be concealed in the seams of shirts, blouses, pants;, and skirts, applied as decoration to garments, worn as belts or suspenders, incorporated into waist packs, knapsacks, or tactical vests, and used as straps for luggage or purses, or as carrying handles for bags of all sizes and descriptions. These separate articles of clothing and accessories can be easily interconnected to form a personal wearable power bus and digital network to which a large number of digital devices may be conveniently attached. Most importantly, these devices attach in a natural manner according to personal taste and need, and can be placed in pockets, attached to garments, and carried in purses and knapsacks, all while drawing power from a common bus and intercommunicating over a bus network.

The snap connectors 38*abcd* can be dispersed along the wires 62*abcd* at desirable locations including the wire ends and wire centers. An end connector may be attached to the ends of the webbing wires 62*abcd* to couple wire segments together or to terminate a wire segment at an end device. Center connectors are placed on the centers of the webbing wires 62*abcd*. Center connectors are versatile because center connectors can be placed anywhere on the webbing wire on the surface of the strap, allowing devices to be attached at any point along the length of the strap. The connectors are preferably an adaptation of conventional ball and socket sew-on snaps for compatibility with conventional sewing manufacturing methods. Several matched pair of snaps can be used as desired to configure a wearable electronic system.

These conventional clothing snaps are widely available in sizes ranging from approximately 5 mm to 8 mm in diameter. The materials may vary, though brass and nickel-plated brass are commonly used as clothing snaps for all sorts of clothing. The snaps are extremely durable and excellent electrical conductors. The short gap between the long leg of the stinger pointed ends 48 and 26 and the disks 12 and 40 allow the snap to lie flat on the strap 60 with the stinger in place. Once the stinger 26 or 48 is inserted, the snap is secured to the strap by common cotton or polyester threads 32 and 56. As a precaution, to prevent the stinger 32 and 48 from shifting or working through the opposite side of the strap, stitching 32*abcd* is applied along the length of the stinger.

An advantage of these connectors, aside from simplicity and ease of attachment, is that these connectors may be attached anywhere along the length of the webbing wires. The wearer can choose any one of all possible placements for the electronic devices. One can attach multiple devices as easily as one, and can rearrange them in accordance with need, circumstances, and personal preference. The connectors can be inserted along the length of the wires 62*abcd* as needed, and unwanted connectors can be quickly removed without disturbing the integrity of the conductor wires 62*abcd* embedded within the strap. In an exemplar form, the utility of conductive wires and the snap connectors transform a simple article of clothing, such as suspenders, into a shared, low voltage, DC power and or communication bus for wearable devices. The matching conductors 62*abcd* of left and right suspender straps may be bonded together electrically at the "V" of the suspenders where the straps cross in the back of a human using two matched sets of ball and socket sew-snap on connectors. The voltage of the power bus varies with the type, form, and chemistry of the attached batteries, typically six to twelve volts. Different devices attached to the bus may require different voltages, such as 3.3V and 5.0V that predominate today so each device attached to the suspenders can be provided with a DC-DC converter that converts the bus voltage to the voltage required by the device. Numerous small, efficient converters are available that accommodate inputs of six to twelve volts and, depending upon the output voltages and current capacity, vary in size from tens of square millimeters to twenty-five square centimeters and are well suited for wear. Small pockets can be attached to the suspenders for holding the batteries for contact to the conductive strap. The conductive strap may power an electronic device that communicates wirelessly as a networking node providing wireless connectivity to the local wired intranet and access to the Internet at large.

The strap is shown with two wires but may contain any number of wires, for example four equidistant individual stranded conductors. With four conductors, two can be devoted to power and two to a network having an exemplar bandwidth from 250 kbs. The attached devices can include a wide range of wearable digital devices suited to a fabric power and network bus. These devices include chemical and environmental sensors, cameras, computing and storage modules, display devices, inertial navigation devices, and wireless communications devices. All of these devices will require power effectively communicated through the strap.

A single data network can be created to permit devices to share information. Devices are easily upgraded or replaced because a new device with equivalent or improved capabilities can be substituted for an older or less capable comparable device on the network. The strap encourages the introduction of new services, because additional devices can be attached to the network. The strap encourages extensive task-specific customization, because the network may be populated with specialized devices suited for a specific use. The wearable power bus and data network strap should be compatible with the manner in which we now wear clothing and carry small objects to be robust and error-free in a broad range of environments from the office to the battlefield, and be machine washable without special precautions. The devices can be actually sewn into the fabric of the strap, but such devices may not be machine washable.

The invention is directed to a wired power and data bus garment strap embedded within the fabric of ordinary, everyday clothing. A single centralized power battery source can be shared in common with many other devices. The strap permits the use of rechargeable batteries for all devices. The frequent daily use of wearable devices dictates the use of rechargeable batteries as a matter of economy and ecology. Those skilled in the art can make enhancements, improvements, and modifications to the invention, and these enhancements, improvements, and modifications may nonetheless fall within the spirit and scope of the following claims.

What is claimed is:

1. A conductive strap for communicating a signal from an electronic device along the strap, the strap comprising, a fabric defining the shape of the strap, and two wires embedded in the fabric, the fabric being an insulating fabric insulating the two wires from each other, a pair of electrical contacts respectively attached to the two wires, the electrical contacts forming an electrical connector for connecting the electronic device to the two wires for communicating the signal along the strap, the two electrical contacts being sew-on snaps comprising a stinger for insertion into the wires, the stinger being conductive for communicating the signal along the wires and through the contacts, the stinger comprising a pointed end for penetration into the wires and a bent end for securing the stinger to the electrical contacts.

2. The strap of claim 1 wherein each of the two wires are stranded bundles of stainless steel conductor.

3. The strap of claim 1 wherein, the two wires are separated by a contact separation distance, and the two electrical contacts are separated by the contact separation distance.

4. The strap of claim 1 wherein the strap is made of Nomex.

5. The strap of claim 1 further comprising thread for securing the stinger to the wire.

6. The strap of claim 1 further comprising thread for securing the snaps to the straps.

7. The strap of claim 1 wherein the sew-on snaps comprise a disk having holes securing the snap to the strap, a mating connector for connecting the electronic device to the wires, the stinger having the pointed end penetrating into the wires and the bent end securing the stinger to the disk, the stinger being separated from the disk by a gap in which is disposed the strap.

8. A system for communicating an electrical signal about a human being, the system comprising, a strap comprising a fabric, two wires and two conductive wire snap contacts, the fabric defining the shape of the strap, the wires embedded in the fabric, the fabric being an insulating fabric insulating the two wires from each other, the two conductive wire snap contacts respectively attached to the two wires, the two conductive wire snap contacts forming an electrical connector for communicating the electrical signal along the strap, a garment for wear by the human being and for supporting the strap, and an electronic device comprising two conductive device snaps for mating connection with the two conductive wire snaps and for communicating the signal between the electronic device and the two wires, each of the two conductive wire snaps and the two electronic device snaps comprising a disk having holes securing the snap to the strap, comprising a mating connector for connecting the electronic device to the wire snap contacts, and comprising a stinger having a pointed end for penetration into the wire snap contacts and a bent end for securing the stinger to the disk.

9. The system of claim 8 wherein the two wires are flexible non-corrosive wires.

10. The system of claim 8 wherein, the two conductive wire snaps contacts comprise female socket garment snaps, and the two conductive device snaps comprise male ball garment snaps.

11. The system of claim 8 wherein the electronic device is a battery provide DC voltages across the two wire for providing a power signal along the two wires, and the two wires are DC power bus wires.

12. The system of claim 11 further comprising, an electronic device coupled to the DC power bus wires for receiving DC power from the battery.

13. The system of claim 12 further comprising, a plurality of electronic devices coupled to the DC power bus wires for receiving DC power from the battery, two communication wires are a communication bus for communicating communications signals, the wires being embedded within the strap, and a plurality of respective sets of communication bus contacts for connecting the plurality of electronic devices to the communication bus for communicating the communications signals between the electronic devices through the communication bus.

* * * * *